US010648213B2

(12) United States Patent
Wright

(10) Patent No.: US 10,648,213 B2
(45) Date of Patent: May 12, 2020

(54) GRAVITY-BASED LOCKING HINGE

(71) Applicant: The Boeing Company, Chicago, IL (US)

(72) Inventor: Alan Wright, Winnipeg (CA)

(73) Assignee: The Boeing Company, Chicago, IL (US)

( * ) Notice: Subject to any disclaimer, the term of this patent is extended or adjusted under 35 U.S.C. 154(b) by 213 days.

(21) Appl. No.: 15/843,224

(22) Filed: Dec. 15, 2017

(65) Prior Publication Data

US 2019/0186187 A1 Jun. 20, 2019

(51) Int. Cl.

| | |
|---|---|
| ***E05D 11/10*** | (2006.01) |
| *E05D 3/02* | (2006.01) |
| *E05D 7/02* | (2006.01) |
| *E05D 5/06* | (2006.01) |
| *E05F 1/06* | (2006.01) |

(52) U.S. Cl.

CPC ..... *E05D 11/1014* (2013.01); *E05D 11/1007* (2013.01); *E05D 3/02* (2013.01); *E05D 5/065* (2013.01); *E05D 7/02* (2013.01); *E05F 1/06* (2013.01); *E05Y 2900/132* (2013.01); *E05Y 2900/20* (2013.01)

(58) Field of Classification Search

CPC . E05D 11/1014; E05D 11/1007; E05D 11/06; Y10T 16/54024; Y10T 16/54

USPC ..... 16/324, 292, 297, 309, 310, 328, 350, 16/351

See application file for complete search history.

(56) References Cited

U.S. PATENT DOCUMENTS 976,392 A * 11/1910 Paynter ..... E05D 7/081 16/317
1,062,623 A * 5/1913 Waters ..... E05D 7/1005 16/262
1,294,044 A * 2/1919 Buckwalter et al. ..... E05D 11/1007 16/351
1,508,013 A * 9/1924 De Waters ..... E05D 3/022 16/351
1,603,408 A * 10/1926 Rickenbacher ..... E05D 11/1078 16/331
1,603,409 A * 10/1926 Rickenbacher ..... E05C 17/38 16/332
1,758,309 A * 5/1930 Block ..... E05D 11/1007 16/332
3,315,298 A * 4/1967 Strien et al. ..... B60N 2/22 16/328

(Continued)

*Primary Examiner* — Justin B Rephann
(74) *Attorney, Agent, or Firm* — Kunzler Bean & Adamson

(57) ABSTRACT

A hinge includes a fixed component defining a vertical axis. The fixed component includes a first support surface with a circular lug path and a first recess formed in the first support surface at an end of the circular lug path. The hinge also includes a pivotable component pivotable about the vertical axis and translationally movable along the vertical axis. The pivotable component includes a first lug extending from the pivotable component in a first direction. The first recess receives and constrains movement of the first lug. The first support surface supports the first lug along the circular lug path and constrains translational movement of the pivotable component in the first direction as the pivotable component pivots about the vertical axis. In the open position, the pivotable component is translationally movable in the first direction and the first lug is receivable into the first recess.

20 Claims, 7 Drawing Sheets

(56) References Cited

U.S. PATENT DOCUMENTS

| | | | | | |
|---|---|---|---|---|---|
| 3,378,881 | A * | 4/1968 | Hentzi | E05F 1/063 | 16/312 |
| 3,448,486 | A * | 6/1969 | Wright | E05D 11/00 | 16/324 |
| 3,643,292 | A * | 2/1972 | Mayer | A47C 1/026 | 16/325 |
| 3,879,146 | A * | 4/1975 | Mayer | A47C 1/026 | 403/93 |
| 3,969,788 | A * | 7/1976 | McCullough | E05D 11/1007 | 16/326 |
| 4,085,969 | A * | 4/1978 | Nakane | B60N 2/2362 | 16/324 |
| 4,263,853 | A * | 4/1981 | Robertson | B61D 19/00 | 105/378 |
| 5,058,239 | A * | 10/1991 | Lee | E06C 1/32 | 16/324 |
| 5,287,596 | A * | 2/1994 | Chen | E05D 11/06 | 16/331 |
| 5,711,053 | A * | 1/1998 | Hafner | E05D 5/128 | 16/380 |
| 6,353,967 | B1 * | 3/2002 | Escobar | E05D 3/02 | 16/331 |
| 8,347,554 | B2 * | 1/2013 | Uto | E02F 9/00 | 49/381 |
| 8,413,382 | B2 * | 4/2013 | Uto | E02F 9/00 | 49/381 |
| 8,707,521 | B1 * | 4/2014 | Mack | E05D 11/06 | 16/326 |
| 8,732,906 | B1 * | 5/2014 | Van Gennep | E05D 11/1007 | 16/229 |
| 2004/0093692 | A1 * | 5/2004 | Cude | E05D 15/56 | 16/350 |

* cited by examiner

GRAVITY-BASED LOCKING HINGE

FIELD

This disclosure relates generally to door hinges, and more particularly to gravity-based locking hinge assemblies.

BACKGROUND

In some situations, it is beneficial to have a door that can be secured in an open position. However, in order to secure a door in an open position, additional hardware, such as a stay, catch, or stop, is necessary. These systems increase cost and present challenges for door alignment, clearance, and maintenance.

SUMMARY

The subject matter of the present application has been developed in response to the present state of the art, and in particular, in response to the problems and disadvantages associated with conventional methods for supporting a door in an open position. Accordingly, the subject matter of the present application has been developed to support a door in an open position that overcomes at least some of the above-discussed shortcomings of prior art techniques.

Described herein is a hinge. The hinge comprises a fixed component defining a vertical axis. The fixed component comprises a first support surface with a circular lug path defined thereon. The fixed component further comprises a first recess formed in the first support surface at an end of the circular lug path. The hinge further comprises a pivotable component pivotable, relative to the fixed component, about the vertical axis between an open position and a closed position, inclusively, and translationally movable, relative to the fixed component, along the vertical axis. The hinge further comprises a first lug non-moveably fixed on the pivotable component and extending from the pivotable component in a first direction. The first recess is configured to receive and constrain movement, along the circular lug path, of the first lug. The first support surface supports the first lug along the circular lug path and constrains translational movement of the pivotable component in the first direction as the pivotable component pivots about the vertical axis. In the open position, the pivotable component is translationally moveable in the first direction and the first lug is receivable into the first recess. The preceding subject matter of this paragraph characterizes example 1 of the present disclosure.

The hinge further comprises a lever pivotably mounted to the pivotable component in engagement with the fixed component. In the open position the lever is pivotable to translationally move the pivotable component along the vertical axis, in a second direction opposite the first direction, to remove the first lug from the first recess. The preceding subject matter of this paragraph characterizes example 2 of the present disclosure, wherein example 2 also includes the subject matter according to example 1, above.

The lever further comprises a handle disposed at a first end of the lever. The lever further comprises a contact element disposed at a second end of the lever, opposite the first end, and engaged with the fixed component. The lever is pivotably mounted to the pivotable component at a pivot point between the first end and the second end of the lever. The lever is configured to pivot about the contact element as the lever pivots about the pivot point to translationally move the pivotable component along the vertical axis in the second direction. The preceding subject matter of this paragraph characterizes example 3 of the present disclosure, wherein example 3 also includes the subject matter according to any one of examples 1 and 2, above.

The contact element of the lever engages with the fixed component at a guide element disposed on a guide surface of the fixed component. The guide surface is oriented perpendicular to the first support surface of the fixed component. The preceding subject matter of this paragraph characterizes example 4 of the present disclosure, wherein example 4 also includes the subject matter according to any one of examples 1-3, above.

The hinge further comprises a pin coupled to the fixed component and the pivotable component and disposed at the vertical axis. The preceding subject matter of this paragraph characterizes example 5 of the present disclosure, wherein example 5 also includes the subject matter according to any one of examples 1-4, above.

The pin is fixedly coupled to the fixed component. The preceding subject matter of this paragraph characterizes example 6 of the present disclosure, wherein example 6 also includes the subject matter according to any one of examples 1-5, above.

The pin is fixedly coupled to the pivotable component. The preceding subject matter of this paragraph characterizes example 7 of the present disclosure, wherein example 7 also includes the subject matter according to any one of examples 1-6, above.

The hinge is operable in an inverted orientation. The pivotable component further comprises a second lug extending from the pivotable component in the second direction. The fixed component further comprises a second support surface defined on the fixed component opposite the first support surface. The second support surface supports the second lug as the pivotable component pivots about the vertical axis. The fixed component further comprises a second recess formed in the second support surface to receive and constrain movement of the second lug when the hinge is in the open position. The preceding subject matter of this paragraph characterizes example 8 of the present disclosure, wherein example 8 also includes the subject matter according to any one of examples 1-7, above.

The hinge is a spring-less hinge and operates under force of gravity. The preceding subject matter of this paragraph characterizes example 9 of the present disclosure, wherein example 9 also includes the subject matter according to any one of examples 1-8, above.

Further described herein is a system. The system comprises a door frame. The system further comprises a door corresponding to the door frame. The system further comprises a fixed component coupled to the door frame. The fixed component defines a vertical axis. The fixed component comprises a first support surface with a circular lug path defined thereon. The fixed component further comprises a first recess formed in the first support surface at an end of the circular lug path. The system further comprises a pivotable component coupled to the door and pivotable, relative to the fixed component, about the vertical axis between an open position and a closed position, inclusively. The pivotable component is further translationally movable, relative to the fixed component, along the vertical axis. The system further comprises a first lug non-movably fixed to the pivotable component and extending from the pivotable component in a first direction. The first recess is configured to receive and constrain movement, along the circular lug path, of the first lug. The first support surface supports the first lug along the circular lug path and constrains translational movement of the pivotable component in the first direction as the pivotable component pivots about the vertical axis. In the open position, the pivotable component is translationally movable in the first direction and the first lug is receivable into the first recess. The preceding subject matter of this paragraph characterizes example 10 of the present disclosure.

The pivotable component further comprises a door mounting location which is coplanar with a first frame mounting location of the fixed component when the door is in the closed position. The preceding subject matter of this paragraph characterizes example 11 of the present disclosure, wherein example 11 also includes the subject matter according to examples 10, above.

The fixed component and the pivotable component form an interior hinge configured to support the door on an interior surface of the door and facilitate an outward opening of the door. The preceding subject matter of this paragraph characterizes example 12 of the present disclosure, wherein example 12 also includes the subject matter according to any one of examples 10 and 11, above.

At least one of the fixed component and the pivotable component is symmetrical in at least one dimension. The preceding subject matter of this paragraph characterizes example 13 of the present disclosure, wherein example 13 also includes the subject matter according to any one of examples 10-12, above.

The first support surface is perpendicular to the vertical axis. The preceding subject matter of this paragraph characterizes example 14 of the present disclosure, wherein example 14 also includes the subject matter according to any one of examples 10-13, above.

The first support surface is tilted relative to the vertical axis. The preceding subject matter of this paragraph characterizes example 15 of the present disclosure, wherein example 15 also includes the subject matter according to any one of examples 10-14, above.

Further described herein is a method. The method comprises pivoting a pivotable component of a hinge relative to a fixed component of the hinge. The fixed component defines a vertical axis. The method further comprises sliding a first lug of the pivotable component along a circular lug path defined on a first support surface of the fixed component. The method further comprises engaging the first lug of the pivotable component with a first recess disposed in the first support surface at an end of the circular lug path, the pivotable component translationally moving along the vertical axis in a first direction in response to the first lug engaging with the first recess. The method further comprises applying a force to the pivotable component in a second direction opposite the first direction to disengage the first lug from the first recess. The preceding subject matter of this paragraph characterizes example 16 of the present disclosure.

Applying the force to the pivotable component to disengage the first lug from the first recess comprises operating a lever coupled to the pivotable component. Operating the lever comprises applying the force to a handle of the lever to translationally move the pivotable component along the vertical axis in the second direction. The preceding subject matter of this paragraph characterizes example 17 of the present disclosure, wherein example 17 also includes the subject matter according to example 16, above.

Operating the lever coupled to the pivotable component further comprises pivoting the lever about a pivot point, the lever being coupled to the pivotable component and comprising a contact element, the contact element engaging with a guide element to apply the force to the fixed component and cause a displacement of the pivotable component relative to the fixed component. The preceding subject matter of this paragraph characterizes example 18 of the present disclosure, wherein example 18 also includes the subject matter according to any one of examples 16 and 17, above.

Applying the force to the pivotable component to disengage the first lug from the first recess comprises applying a force to a door coupled to the pivotable component to translationally move the pivotable component along the vertical axis in the second direction. The preceding subject matter of this paragraph characterizes example 19 of the present disclosure, wherein example 19 also includes the subject matter according to any one of examples 16-18, above.

Engaging the first lug of the pivotable component with the first recess comprises translationally moving the pivotable component along the vertical axis in the first direction under force of gravity. The preceding subject matter of this paragraph characterizes example 20 of the present disclosure, wherein example 20 also includes the subject matter according to any one of examples 16-19, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Embodiments described below relate to a gravity-based hinge. The hinge provides the ability to open a door and access a compartment with the door secured open by the door hinge itself. While other solutions include catches or stops to secure the door, these introduce complexity and cost into the door system. With this gravity-based approach, the operation of the hinge is automatic and relatively simple. As the user opens the door, a pivotable component of the hinge glides along a support surface of a fixed component of the hinge. As the door reaches the fully open position, gravity, acting on the door and the hinge, engages the pivotable component into a recess formed in the first support surface of the fixed component of the hinge. The first recess prevents the door from closing until a lifting force is applied to the door or the pivotable component of the hinge. In response to the lifting force, the pivotable component disengages from the first recess formed in the first support surface and the door can then be closed. Embodiments of the hinge can be incorporated with other embodiments of the hinge to support a door at multiple locations. In embodiments involving multiple hinges, a single hinge may receive the lifting force to disengage the pivotable components of all the hinges attached to the door and release the door to close. Embodiments of the hinge are also invertible for use in multiple orientations. Features and aspects of the hinge described herein reduce cost, complexity, and chance for error and provide a single hinge design which is deployable in a plurality of orientations and in combination with one another.

Figure 1A:
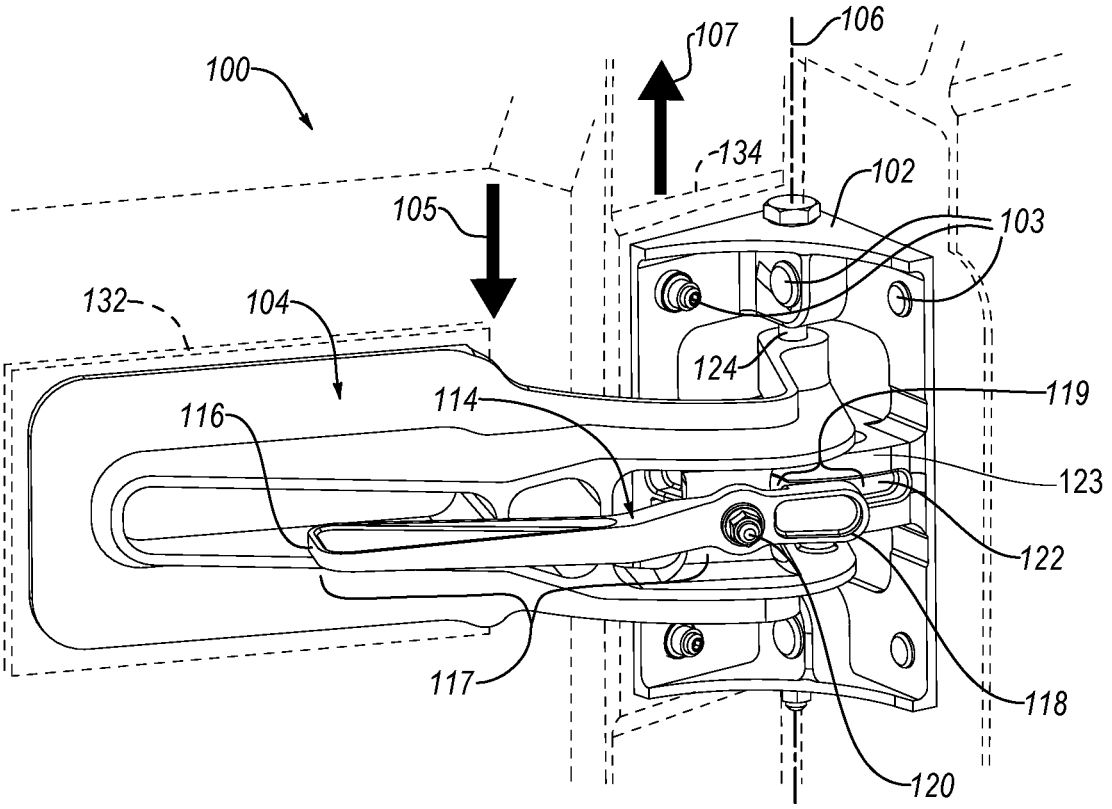
FIG. 1A is a perspective view of a hinge in an intermediate position between an open position and a closed position, according to one or more examples of the present disclosure.

In the illustrated embodiment of FIG. 1A, the hinge 100 includes a fixed component 102 and a pivotable component 104. The fixed component 102 is mountable to a door frame at one or more of the frame mounting location 134 of the fixed component 102. For example, the fixed component 102 may include mounting hardware 103, such as screws, screw holes, pins, bolts, or other mounting hardware or structures, that help facilitate mounting of the frame mounting location 134 of the fixed component 102 to the door frame or other anchoring structure.

In the illustrated embodiment, the fixed component 102 forms an angle to facilitate mounting of the fixed component 102 in a corner formed by a door frame. The frame mounting location 134 of the fixed component 102 may also have a flat geometry, include an angle that is more acute or obtuse, or have a curved geometry to complement a shape of the surface of the door frame to which the frame mounting location 134 is mounted.

The fixed component 102 defines a vertical axis 106. In the illustrated embodiment, the vertical axis 106 corresponds (e.g., is coaxial) with a pin 124, or other structure, of the fixed component 102 that is capable of supporting or facilitating rotation of the pivotable component 104 relative to the fixed component 102. The pin 124 may be non-movably fixed or coupled to the fixed component 102 or be coupled to the fixed component while having at least one of a rotational and a translational freedom.

In the illustrated embodiment, the fixed component 102 includes a first support surface 110. The first support surface 110 provides upwardly directed support during movement of the pivotable component 104. More specifically, the first support surface 110 reduces or constrains translational movement of the pivotable component 104 in a first direction 105. The first support surface 110 may be made of a plastic, metal, composite, or other material. Additionally, the first support surface 110 may be coated, lubricated, polished, hardened, doped, or otherwise treated to reduce the friction and/or increase the durability of the first support surface 110. The first support surface 110 is described in greater detail below.

The fixed component 102 also includes a guide surface 123. In the illustrated embodiment, the guide surface 123 is a surface of the fixed component 102 that is oriented at some non-zero angle relative to the first support surface 110. For example, the guide surface 123 may be a surface oriented at a right angle or perpendicular relative to the first support surface 110.

In the illustrated embodiment, a guide element 122 is formed in the guide surface 123. The guide element 122 is a physical structure that is a variation in the structure or form of the guide surface 123. The guide element 122, as shown, is a channel or groove formed in the guide surface 123. In other embodiments, the guide element 122 is a raised portion, rail, capture, or other structure formed in or on the guide surface 123.

The pivotable component 104 is pivotable relative to the fixed component 102. The pivotable component 104 includes a door mounting location 132 at which the pivotable component 104 may be mounted to a door. In some embodiments, the door mounting location 132 is parallel or coplanar to the frame mounting location 134 in the closed position. The door mounting location 132 of the pivotable component 104 may also be offset or disposed at an angle relative to the frame mounting location 134 of the fixed component 102. The door mounting location 132 is parallel to the vertical axis 106 and, in some embodiments, rotates about the vertical axis 106 as the pivotable component 104 moves between the closed position and the open position, inclusively.

The pivotable component 104 pivots about the vertical axis 106. The pivotable arrangement of the pivotable component 104 relative to the fixed component 102 allows for the pivotable component 104 to pivotably move between a closed position and an open position, inclusively. Additionally, the pivotable component 104 is translationally moveable relative to the fixed component 102. The translational movement of the pivotable component 104 relative to the fixed component 102 is along (e.g., parallel to) the vertical axis 106. For example, in the illustrated embodiment, the pivotable component 104 can move in the upward or second direction 107 and downward or first direction 105 along the vertical axis 106. To accommodate translational movement, the pivotable component 104 is sized to allow the translational movement within the constraints of the fixed component 102.

Figure 1B:
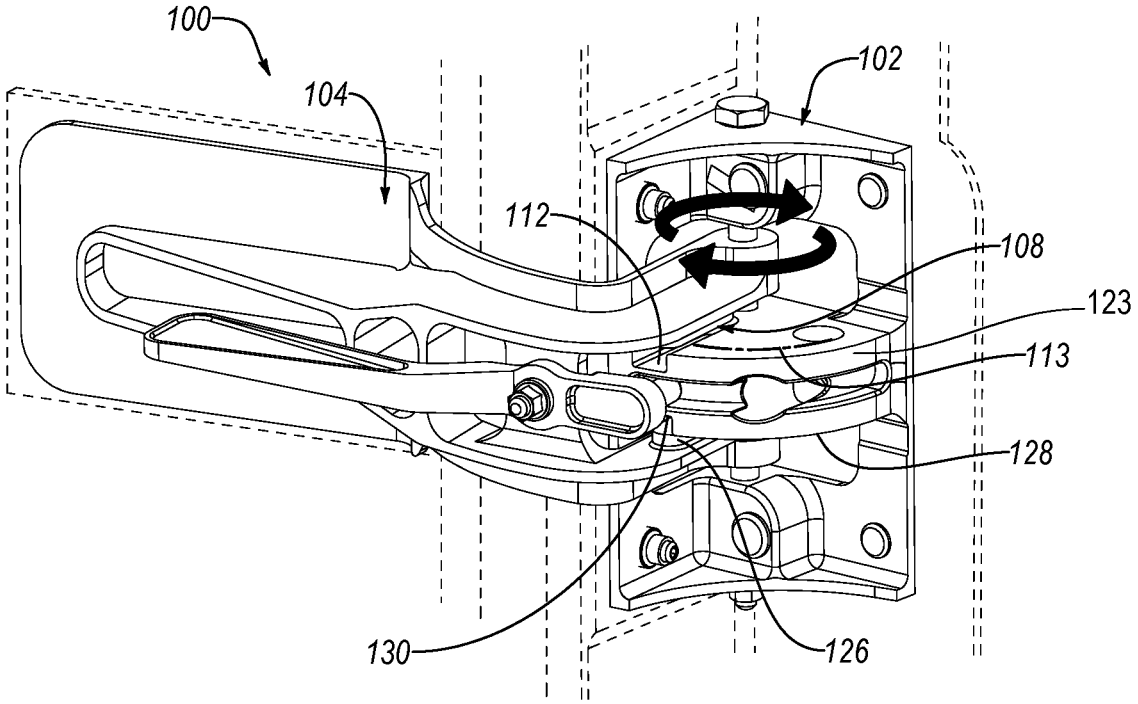
FIG. 1B is a perspective view of the hinge of FIG. 1A in a disengaged open position, according to one or more examples of the present disclosure.

The pivotable component 104 includes a first lug 108 (see, e.g., FIG. 1B). The first lug 108 is fixedly coupled to the pivotable component 104. The first lug 108 may be integrally co-formed with the pivotable component 104 or formed separately and attached to the pivotable component 104. The first lug 108 forms a projection extending from the pivotable component 104 in the first direction 105. In other embodiment, the first lug 108 may be the structure of the pivotable component itself sized to engage with the first recess 112.

In some embodiments, depending on the orientation of the fixed component 102, the first direction 105 is a gravitationally downward direction (i.e., a vertically downward direction). However, the fixed component 102 may be oriented such that the first direction 105 is non-vertical, but also non-horizontal, so as to at least partially receive gravitational assistance.

In the illustrated embodiment, the hinge 100 also includes a lever 114. The lever 114 is pivotably mounted to the pivotable component 104 at a pivot point 120. The pivot point 120 allows for pivotal motion of the lever 114 relative to the pivotable component 104. The pivot point 120 may include a bearing, a bolt and nut, a post and clip, or other hardware or structure forming part of one or more of the pivotable component 104 or the lever 114.

The lever 114 includes a handle 116 disposed at a first end 117 of the lever 114. In the illustrated embodiment, the handle 116 is a flattened portion of the lever 114 to provide a physical interface for a user to operate the lever 114. The flattened shape of the illustrated handle 116 improves the ease of lifting or manipulating the lever 114. The handle 116 may further include surface texturing, grip material, or other features to improve the user interface to reduce slipping, improve feel, or reduce chance of injury or failure at the handle 116.

The lever 114 includes a contact element 118 disposed at a second end 119 of the lever 114 opposite the first end 117 of the lever 114. The contact element 118 engages the fixed component 102 at the guide element 122 formed in the guide surface 123. The engagement between the contact element 118 and the guide element 122 allows translational movement of the pivotable component 104 relative to the fixed component 102 and pivotal movement of the lever 114 relative to the fixed component 102. With the first lug 108 in contact with the first support surface 110, the lever 114 is maintained in a neutral position at which the lever is neither depressed nor elevated. This arrangement is facilitated by the engagement of the contact element 118 with the guide element 122.

In the illustrated embodiment shown in FIG. 1B, the pivotable component 104 is pivoted clockwise as shown, into the open position. As the pivotable component 104 is pivoted in the clockwise direction toward the open position, the first lug 108 moves across the first support surface 110 following a circular lug path 113 defined on the first support surface 110. At the end of the circular lug path 113, a first recess 112 is formed in the first support surface 110. As the pivotable component 104 reaches the open position, the first lug 108 aligns, and engages, with the first recess 112. The first recess 112 is configured to receive and constrain movement of the first lug 108 along the circular lug path 113.

In some embodiments, the first lug 108 engages with the first recess 112 under the force of gravity. In other words, once the pivotable component 104 reaches the open position, gravity effectively pulls the pivotable component 104 downward causing a translational movement of the pivotable component 104 along the vertical axis 106, which causes the first lug 108 to drop into the first recess 112. While in other embodiments, magnets, springs, and other force elements may be incorporated, the use of a gravity operated system reduces weight, complexity, and cost.

Constraining movement of the first lug 108 within the first recess 112 results in the pivotable component 104 being self-retained in the open position relative to the fixed component 102. This allows the pivotable component 104 to maintain a door in the open position without user intervention. Additionally, engagement of the first lug 108 in the first recess 112 occurs smoothly in response to the pivotable component 104 reaching the open position without the need for user interaction at the lever 114 or the rest of the hinge 100.

In the illustrated embodiment, the pivotable component 104 also includes a second lug 126 extending from the pivotable component 104 in a second direction 107. The second direction 107 is opposite the first direction 105 and is parallel to the vertical axis 106. The second lug 126 corresponds to a second support surface 128 of the fixed component 102 and a second recess 130 formed in the second support surface 128.

In the illustrated embodiment, the symmetrical arrangement of the first lug 108 and the second lug 126, the first support surface 110 and the second support surface 128, and the first recess 112 and the second recess 130 allows for the hinge 100 to be installed in a right-hand or left-hand configuration. In other words, the hinge 100 may be invertible without modification or adjustment.

In the illustrated embodiment, the first lug 108 and the second lug 126 are shown as protrusions having an elongated geometry extending towards the vertical axis 106. At least one of the first lug 108 and the second lug 126 may also be circular, rounded, sloped, square, or the like. The shape of one or more of the first lug 108 and the second lug 126 may correspond to the first recess 112 and the second recess 130. While the first recess 112 and the second recess 130 are shown with straight and orthogonal boundaries, one or both of the first recess 112 and the second recess 130 may have a sloped boundary. For example, the first recess 112 may have a sloped boundary on the side of the first recess 112 proximate the first support surface 110 so that engagement of the first lug 108 with the first recess 112 is less abrupt. The same boundary may also have a non-linear or curved geometry to provide a less abrupt engagement while improving retention of the first lug 108. Other geometries and arrangements may provide other advantages and performance.

In the illustrated embodiment, the pivotable component 104 is pivoted around the vertical axis to a disengaged open position, as shown. In the disengaged open position, the first lug 108 has left the circular lug path 113 and is aligned with but disengaged from the first recess 112.

Figure 1C:
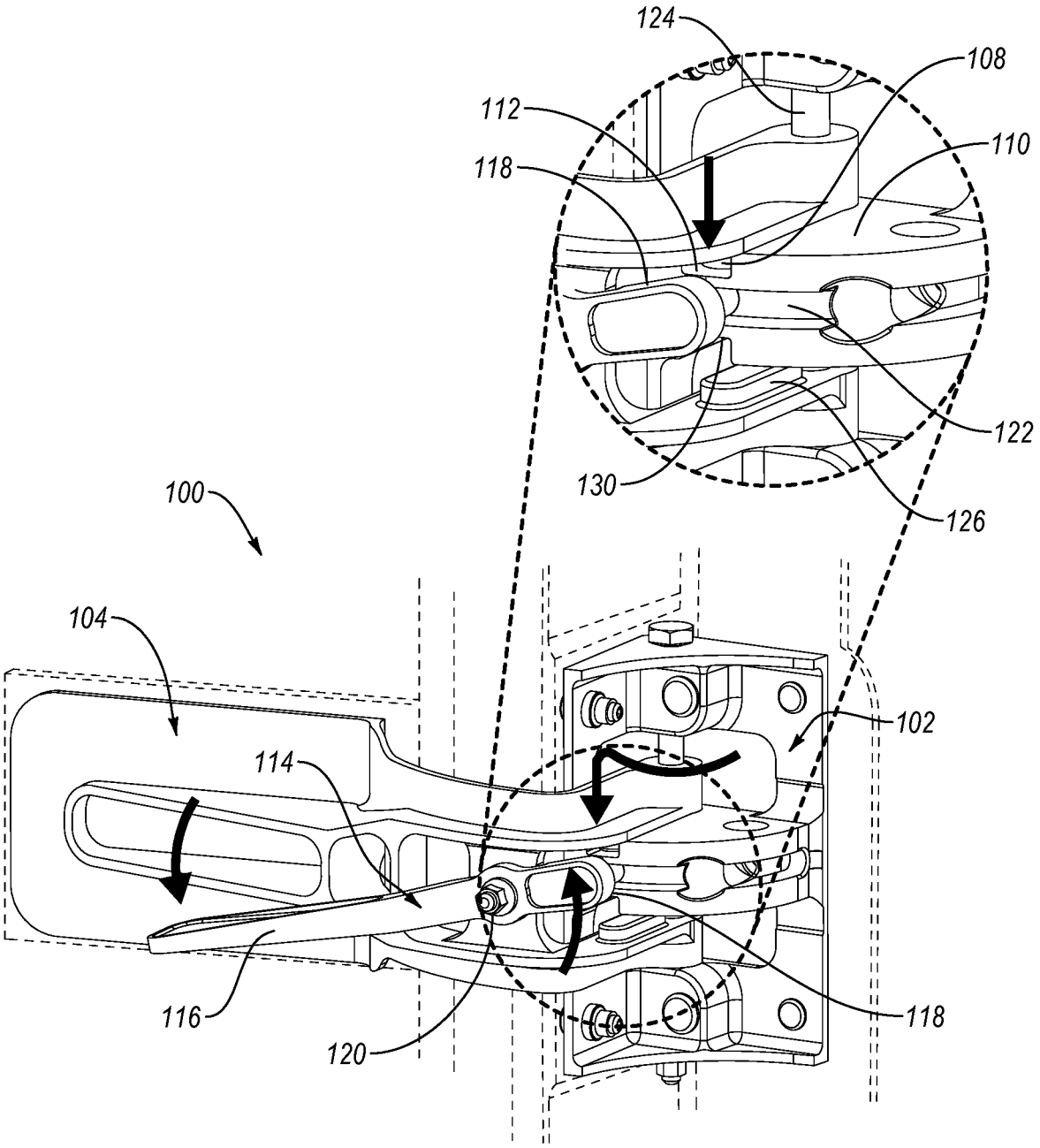
FIG. 1C is a perspective view of the hinge of FIG. 1A in an engaged open position, according to one or more examples of the present disclosure.

In the illustrated embodiment of FIG. 1C, the pivotable component 104 has translationally moved relative to the fixed component 102 to engage the first lug 108 with the first recess 112. As described above, the first lug 108 may engage with the first recess 112 under the force of gravity. As the first lug 108 engages with the first recess 112, the pivotable component 104 moves downward, as indicated in FIG. 1C.

As the pivotable component 104 translates downward, the guide element 122 of the fixed component 102 directs the contact element 118 of the pivotable component 104 upward relative to the pivotable component 104. In the illustrated embodiment, the guide element 122 extends along and entire path of travel of the contact element 118. Alternatively, the guide element 122 may be omitted in the region of the guide surface 123 distal from the first recess 112. For example, the contact element 118 may be free to move on the guide surface 123 near the first support surface 110 and then engage the guide element 122 to interface with and align the contact element 118 as the first lug 108 approaches the first recess 112.

The depicted upward movement of the contact element 118 causes the lever 114 to pivot about the pivot point 120. The pivoting of the lever 114 lowers the handle 116 of the lever 114, as illustrated. In the depicted state, the hinge 100 is in the open engaged position and the pivotable component 104 is restrained relative to the fixed component 102.

Force applied to the pivotable component 104 to pivot the pivotable component 104 toward the closed position is resisted by the first lug 108 with the first lug 108 engaged in the first recess 112. To release the pivotable component 104 to pivot towards the closed position, the first lug 108 is lifted or disengaged from the first recess 112.

Figure 1D:
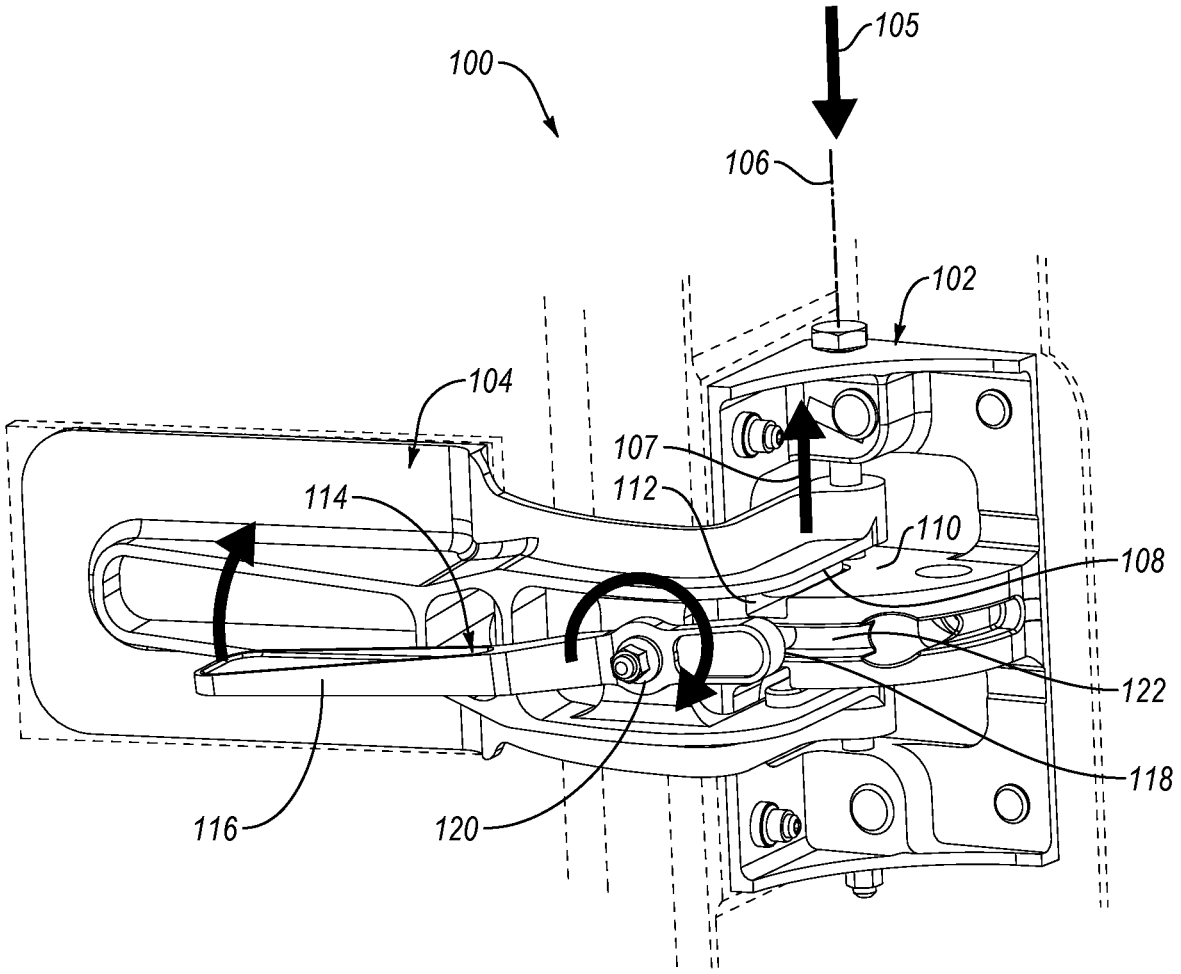
FIG. 1D is a perspective view of the hinge of FIG. 1A in the disengaged open position, according to one or more example of the present disclosure.

In the illustrated embodiment of FIG. 1D, a lifting or upward force in the second direction 107 is applied to the handle 116 of the lever 114. The lever 114 rotates in a clockwise manner about the pivot point 120 in response to the force applied to lift the handle 116. The rotation of the lever 114 forces the contact element 118 downward in the first direction 105. The downward movement of the contact element 118 within the guide element 122 translates the pivotable component 104 in the second direction 107 or upward along the vertical axis 106. As the pivotable component 104 translates upward, the first lug 108 is disengaged from or lifted out of the first recess 112.

Alternatively, the first lug 108 may be lifted out of the first recess 112 in response to a force applied in the second or upward direction on a door to which the pivotable component 104 is coupled. For example, if a user wishes to close the door from the secured open position, the use may lift up on the door. This disengages the first lug 108 from the first recess 112 and allows the pivotable component 104 to pivot relative to the fixed component 102 to move the door to the closed position.

With the first lug 108 disengaged from the first recess 112, the pivotable component 104 is free to pivot about the vertical axis 106 relative to the fixed component 102. The pivotable component 104 may then be pivoted towards and into the closed position with the first lug 108 supported by and moving along the first support surface 110. Therefore, in some embodiments, the illustrated embodiment allows a user to quickly and easily operate a hinge 100 that is capable of securing a door in an open position under the force of gravity without user intervention.

Figure 2A:
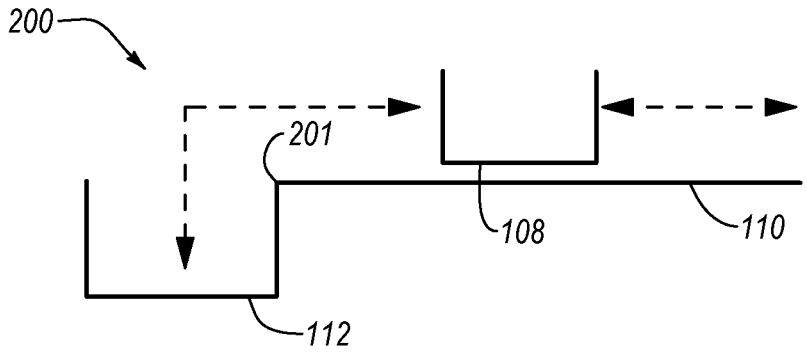
FIG. 2A is a schematic view of a support arrangement, according to one or more examples of the present disclosure.

In the illustrated embodiment of FIG. 2A, a support arrangement 200 is shown. The support arrangement 200 includes a first lug 108 movable along a first support surface 110 and engageable with a first recess 112. In the illustrated embodiment, a transition 201 between the first support surface 110 and the first recess 112 is a right angle. With this transition 201, the first lug 108 passes along the first support surface 110 and drops in to engage with the first recess 112.

Figure 2B:
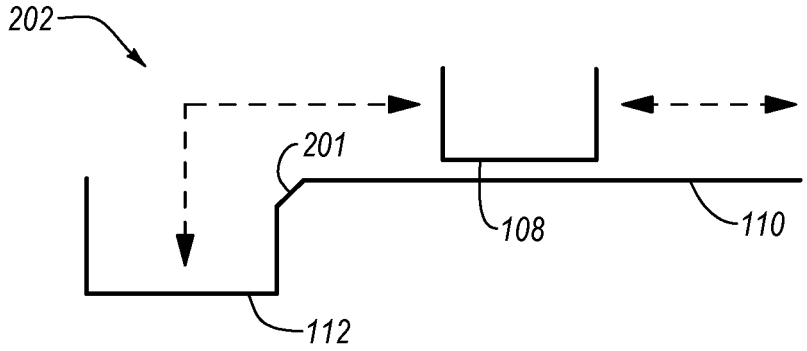
FIG. 2B is a schematic view of a support arrangement, according to one or more other examples of the present disclosure.

In the illustrated embodiment of FIG. 2B, another embodiment of a support arrangement 202 is shown. The support arrangement 202 includes a first lug 108 movable along a first support surface 110 and engageable with a first recess 112. In the illustrated embodiment, the transition 201 is a hybrid of the transition 201 of FIG. 2A and that of FIG. 2B in that the angled portion of the transition 201 is smaller. This results in a less abrupt engagement with improved retention of the first lug 108 by the first recess 112.

Figure 2C:
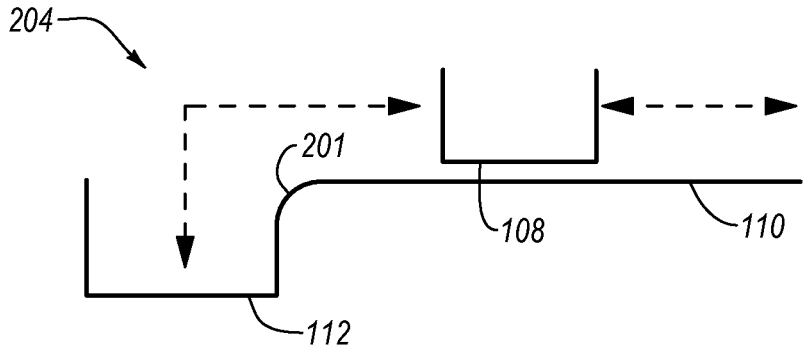
FIG. 2C is a schematic view of a support arrangement, according to one or more further examples of the present disclosure.

In the illustrated embodiment of FIG. 2C, another embodiment of a support arrangement 204 is shown. The support arrangement 204 includes a first lug 108 movable along a first support surface 110 and engageable with a first recess 112. In the illustrated embodiment, the transition 201 includes a non-linear or curved geometry to provide a smooth engagement of the first lug 108 with the first recess 112. This embodiment may provide improved wear characteristics.

Figure 3:
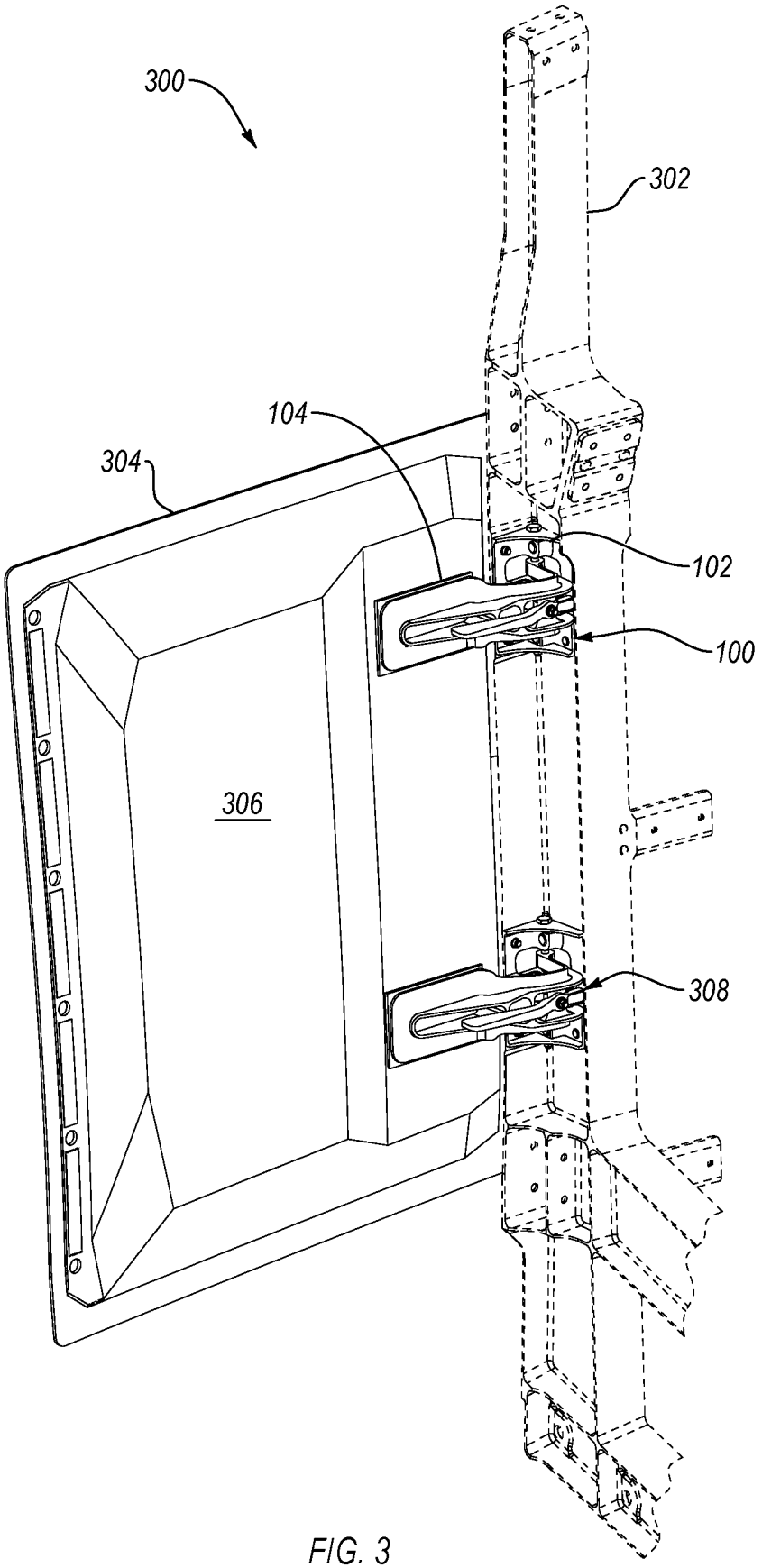
FIG. 3 is a perspective view of a door system with the door in a closed position, according to one or more examples of the present disclosure.

In the illustrated embodiment of FIG. 3, the system 300 includes a hinge 100 coupled to a door frame 302 and door 304 to operably secure the door 304 relative to the door frame 302. The fixed component 102 is coupled to the door frame 302. The pivotable component 104 is coupled to the door 304. In the illustrated embodiment, the pivotable component 104 positions the door 304 so that an inside surface 306 of the door 304 is aligned with an inside surface of the door frame 302. In other embodiments, the pivotable component 104 positions the door 304 so that the inside surface 306 of the door 304 aligns with an outside surface of the door frame 302.

In some embodiments, a second hinge 308 is coupled to the door frame 302 and the door 304. The second hinge 308 may be incorporated with or without all of the structure and elements described above with respect to the preceding figures. For example, the second hinge 308 may include or omit the lever 114 as described above. In some embodiments, one of the hinge 100 and the second hinge 308 includes a lever 114 while the other does not. In other embodiments, both the hinge 100 and second hinge 308 each include a lever 114. While the illustrated embodiment shows the hinge 100 and the second hinge 308, one or more than two levers may be used on a door frame 302 and door 304. In the illustrated embodiment, the hinge 100 and second hinge 308 are located on an inside surface 306 of the door 304 and facilitate outward swinging of the door 304 to reach an open position. In other embodiments, the hinge 100 and second hinge 308 may be located on the outside of a door and door frame and facilitate outward opening of the door 304. Other arrangements, such as incorporating the hinges with one or more inward opening doors are also within the scope of the embodiments described herein.

Figure 4:
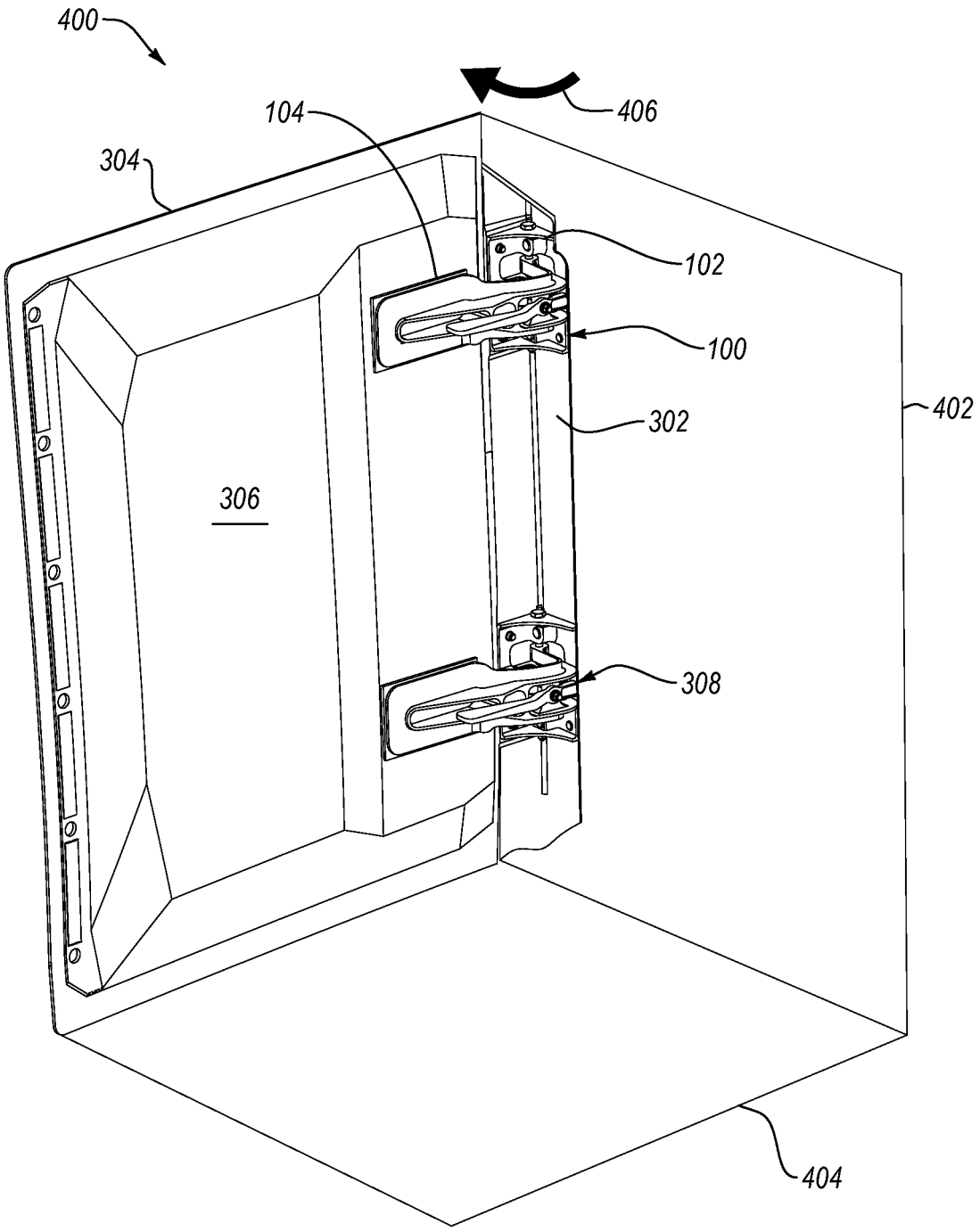
FIG. 4 is a perspective view of a compartment with the door in a closed position, according to one or more examples of the present disclosure.

In the illustrated embodiment of FIG. 4, the compartment 400 has the door 304 in the closed position. The compartment 400 includes the door 304, a hinge-side vertical wall 402, and a floor 404 (a back wall, door-side vertical wall, and ceiling are omitted for clarity). The door 304 is configured to open in a clockwise direction 406 to provide access to the compartment 400. The door 304 may reach an engaged open position before coming parallel with the hinge-side vertical wall 402, as it comes parallel with the hinge-side vertical wall 402, or after passing parallel with the hinge-side vertical wall 402. In some embodiments, the hinge 100 may be adjustable to change the orientation of the engaged open position of the door 304 relative to the hinge-side vertical wall 402.

Figure 5:
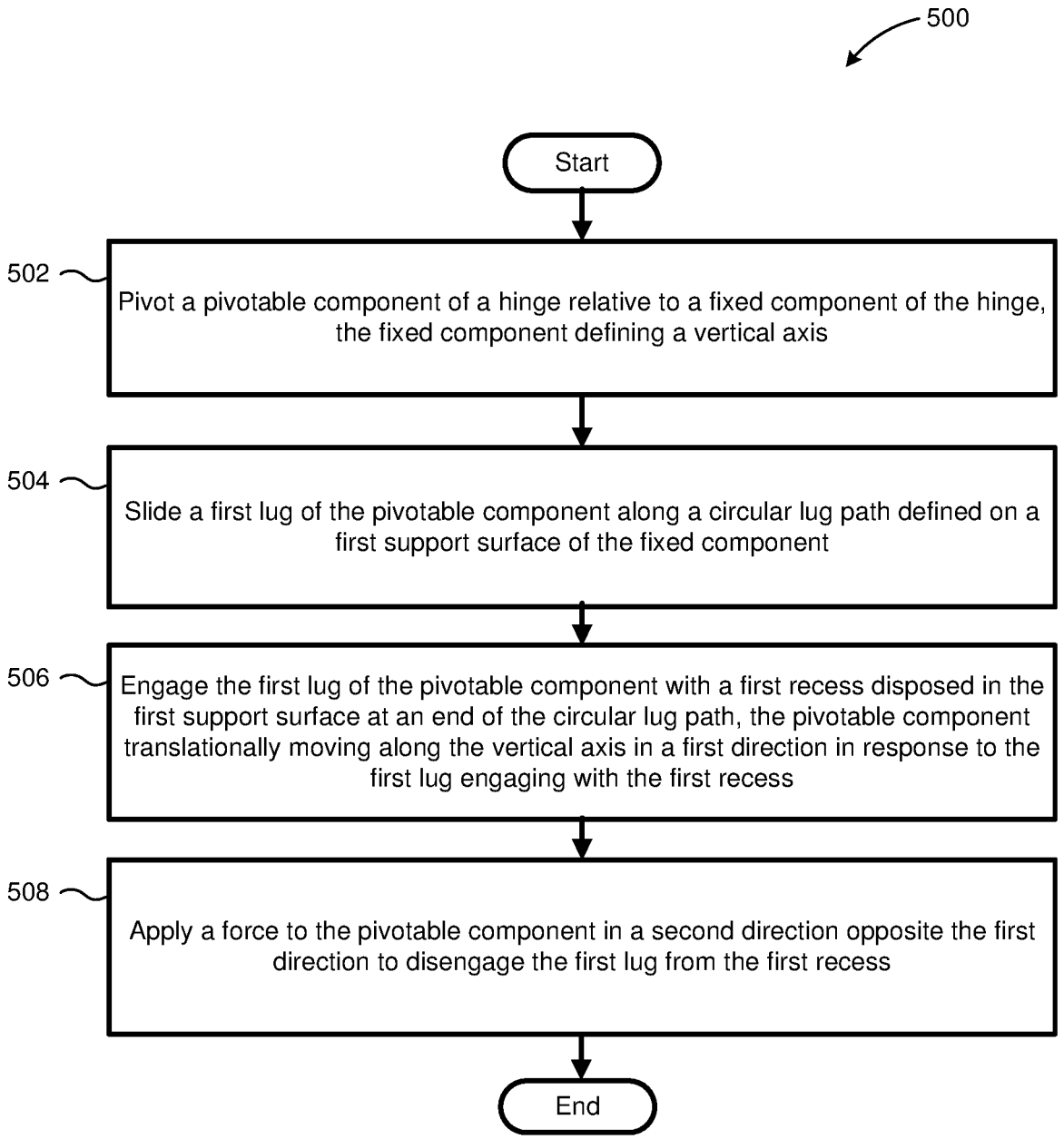
FIG. 5 is a schematic flow diagram of a method of operating a hinge, according to one or more examples of the present disclosure.

The method 500, shown in FIG. 5, begins and pivots 502 a pivotable component 104 of a hinge 100 relative to a fixed component 102 of the hinge 100. The fixed component 102 defines a vertical axis 106. The method 500, in some embodiments, slides 504 a first lug 108 of the pivotable component 104 along a circular lug path 113 defined on a first support surface 110 of the fixed component 102. The method 500, in various embodiments, engages 506 the first lug 108 of the pivotable component 104 with a first recess 112 disposed in the first support surface 110 at an end of the circular lug path 113. The pivotable component 104 translationally moves along the vertical axis 106 in a first direction 105 in response to the first lug 108 engaging with the first recess 112. The method 500, in certain embodiments, applies 508 a force to the pivotable component 104 in a second direction 107 opposite the first direction 105 to disengage the first lug 108 from the first recess 112. The illustrated method 500 then ends.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A hinge comprising:

a fixed component defining a vertical axis and comprising:

a first support surface with a circular lug path defined thereon; and a first recess formed in the first support surface at an end of the circular lug path;

a pivotable component pivotable, relative to the fixed component, about the vertical axis between an open position and a closed position, inclusively, and translationally movable, relative to the fixed component, along the vertical axis;

a first lug non-movably fixed to the pivotable component and extending from the pivotable component in a first direction, wherein:

the first recess is configured to receive and constrain movement of the first lug about the vertical axis;

the first support surface supports the first lug along the circular lug path and constrains translational movement of the pivotable component in the first direction as the pivotable component pivots about the vertical axis; and in the open position, the pivotable component is translationally movable in the first direction and the first lug is receivable into the first recess; and a lever pivotably mounted to the pivotable component in engagement with the fixed component, wherein in the open position the lever is pivotable to translationally move the pivotable component along the vertical axis, in a second direction opposite the first direction, to remove the first lug from the first recess.

2. The hinge of claim 1, wherein:

the lever comprises:

a handle disposed at a first end of the lever; and a contact element disposed at a second end of the lever, opposite the first end, and engaged with the fixed component;

the lever is pivotably mounted to the pivotable component at a pivot point between the first end and the second end of the lever; and the lever is configured to pivot about the contact element as the lever pivots about the pivot point to translationally move the pivotable component along the vertical axis in the second direction.

3. The hinge of claim 2, wherein the contact element of the lever engages with the fixed component at a guide element disposed on a guide surface of the fixed component, the guide surface oriented perpendicular to the first support surface of the fixed component.

4. The hinge of claim 1, further comprising a pin coupled to the fixed component and the pivotable component and disposed at the vertical axis.

5. The hinge of claim 4, wherein the pin is fixedly coupled to the fixed component.

6. The hinge of claim 4, wherein the pin is fixedly coupled to the pivotable component.

7. The hinge of claim 1, wherein:

the hinge is operable in an inverted orientation;

the pivotable component further comprises a second lug extending from the pivotable component in a second direction; and the fixed component further comprises:

a second support surface defined on the fixed component opposite the first support surface, the second support surface to support the second lug as the pivotable component pivots about the vertical axis; and a second recess formed in the second support surface to receive and constrain movement of the second lug when the hinge is in the open position.

8. The hinge of claim 1, wherein the hinge is a spring-less hinge and operates under force of gravity.

9. The hinge according to claim 1, wherein the fixed component further comprises a beveled edge at a transition between the first support surface and the first recess.

10. The hinge according to claim 1, wherein the fixed component further comprises a radiused edge at a transition between the first support surface and the first recess.

11. A system comprising:

a door frame;

a door corresponding to the door frame;

a fixed component coupled to the door frame, the fixed component defining a vertical axis and comprising:

a first support surface with a circular lug path defined thereon; and a first recess formed in the first support surface at an end of the circular lug path;

a pivotable component coupled to the door and pivotable, relative to the fixed component, about the vertical axis between an open position and a closed position, inclusively, and translationally movable, relative to the fixed component, along the vertical axis;

a first lug non-movably fixed to the pivotable component and extending from the pivotable component in a first direction, wherein:

the first recess is configured to receive and constrain movement of the first lug about the vertical axis;

the first support surface supports the first lug along the circular lug path and constrains translational movement of the pivotable component in the first direction as the pivotable component pivots about the vertical axis; and in the open position, the pivotable component is translationally movable in the first direction and the first lug is receivable into the first recess; and a lever pivotably mounted to the pivotable component in engagement with the fixed component, wherein in the open position the lever is pivotable to translationally move the pivotable component along the vertical axis, in a second direction opposite the first direction, to remove the first lug from the first recess.

12. The system of claim 11, wherein the pivotable component further comprises a door mounting location which is coplanar with a first frame mounting location of the fixed component when the door is in the closed position.

13. The system of claim 11, wherein the fixed component and the pivotable component form an interior hinge configured to support the door on an interior surface of the door and facilitate an outward opening of the door.

14. The system of claim 11, wherein at least one of the fixed component and the pivotable component is symmetrical in at least one dimension.

15. The system of claim 11, wherein the first support surface is perpendicular to the vertical axis.

16. The system of claim 11, wherein the first support surface is tilted relative to the vertical axis.

17. A method comprising:

pivoting a pivotable component of a hinge relative to a fixed component of the hinge, the fixed component defining a vertical axis;

sliding a first lug of the pivotable component along a circular lug path defined on a first support surface of the fixed component;

engaging the first lug of the pivotable component with a first recess disposed in the first support surface at an end of the circular lug path, the pivotable component translationally moving along the vertical axis in a first direction in response to the first lug engaging with the first recess; and applying a force to the pivotable component in a second direction opposite the first direction to disengage the first lug from the first recess;

wherein applying the force to the pivotable component to disengage the first lug from the first recess comprises operating a lever coupled to the pivotable component, wherein operating the lever comprises applying the force to a handle of the lever to translationally move the pivotable component along the vertical axis in the second direction.

18. The method of claim 17, wherein operating the lever coupled to the pivotable component further comprises pivoting the lever about a pivot point, the lever being coupled to the pivotable component and comprising a contact element, the contact element engaging with a guide element to apply the force to the fixed component and cause a displacement of the pivotable component relative to the fixed component.

19. The method of claim 17, wherein applying the force to the pivotable component to disengage the first lug from the first recess comprises applying a force to a door coupled to the pivotable component to translationally move the pivotable component along the vertical axis in the second direction.

20. The method of claim 17, wherein engaging the first lug of the pivotable component with the first recess comprises translationally moving the pivotable component along the vertical axis in the first direction under force of gravity.

* * * * *